United States Patent [19]

Yamamoto et al.

[11] Patent Number: 4,496,583

[45] Date of Patent: Jan. 29, 1985

[54] PAPER-LIKE POLYESTER FIBER SHEET AND PROCESS FOR PRODUCING THE SAME

[75] Inventors: Tamio Yamamoto; Tsukasa Kobayashi, both of Matsuyama; Tadashi Hirakawa, Kusatsu; Makoto Yoshida, Ibaraki; Masumi Okumura, Joyo, all of Japan

[73] Assignee: Teijin Limited, Osaka, Japan

[21] Appl. No.: 469,578

[22] Filed: Feb. 24, 1983

Related U.S. Application Data

[63] Continuation of Ser. No. 278,073, Jun. 29, 1981, abandoned.

[30] Foreign Application Priority Data

| | | | |
|---|---|---|---|
| Jul. 7, 1980 | [JP] | Japan | 55-91663 |
| Jul. 11, 1980 | [JP] | Japan | 55-93900 |
| Nov. 11, 1980 | [JP] | Japan | 55-157628 |
| Nov. 12, 1980 | [JP] | Japan | 55-158149 |

[51] Int. Cl.[3] ..... D21F 11/00; D04H 1/58

[52] U.S. Cl. ..... 428/288; 162/157.3; 428/296

[58] Field of Search ..... 428/357, 359, 360, 364, 428/288, 296; 162/157.3

[56] References Cited

U.S. PATENT DOCUMENTS

| | | | |
|---|---|---|---|
| 3,309,260 | 3/1967 | Boese | 428/296 X |
| 3,394,047 | 7/1968 | Sommer et al. | 162/157.3 |
| 3,401,078 | 9/1968 | Grossteinbeck et al. | 428/296 X |
| 3,489,643 | 1/1970 | Hoffman | 428/395 X |
| 3,730,830 | 5/1973 | Driscoll | 162/157.3 X |
| 4,267,016 | 5/1981 | Okazaki et al. | 162/157.4 X |

*Primary Examiner*—Lorraine T. Kendell

*Attorney, Agent, or Firm*—Burgess, Ryan & Wayne

[57] ABSTRACT

A paper-like polyester sheet having an enhanced filtering property, an excellent mechanical strength and satisfactory touch and appearance, comprises polyester staple fibers and has a coefficient of air flow resistance of 1,000 to 50,000 dyn.s/cm$^4$ at a volume fraction of the fibers of from 0.01 to 0.24.

21 Claims, No Drawings

PAPER-LIKE POLYESTER FIBER SHEET AND PROCESS FOR PRODUCING THE SAME

This is a continuation of application Ser. No. 278,073, filed June 29, 1981, now abandoned.

FIELD OF THE INVENTION

The present invention relates to a paper-like polyester fiber sheet and a process for producing the same. More particularly, the present invention relates to a paper-like polyester fiber sheet having excellent mechanical strength, dimensional stability, thermal resistance, and filtering property and satisfactory touch, softness, air and water permeabilities and appearance, and a process for producing the same by utilizing a wet paper-making method.

BACKGROUND OF THE INVENTION

It is known that paper-like non-woven sheets are produced from various types of synthetic fibers, for example, polypropylene fibers, acrylic fibers and water-insoluble polyvinyl alcohol fibers. These non-woven sheets are produced by a wet sheet-forming process, a dry sheet-forming process or a spun bond process. Also, it is known that among the various sheet-forming processes, the wet paper-making process is the most beneficial for industrially producing the synthetic fiber non-woven sheet. However, the non-woven sheets produced from the above-mentioned types of synthetic fibers are unsatisfactory in mechanical strength, thermal resistance, touch and/or filtering property.

Recently, it was attempted to utilize polyester fibers to produce a paper-like non-woven sheet. However, the resultant paper-like polyester fiber sheet was still unsatisfactory in mechanical strength, and touch, softness, uniformity of quality and structure. Especially, it was found that, in the case of filtering material made from the polyester fiber sheet, a modification of the filtering material so as to increase the collecting effect of the filtering material causes the pressure loss of the filtering material to increase and causes the durability of the filtering material to be shortened. Also, the modification of the filtering material so as to decrease the pressure loss or to increase the durability of the filtering material, causes the collecting effect of the filtering material to be decreased.

Also, it was found that in the wet paper-making process, conventional polyester staple fibers were unevenly dispersed in water and the resultant sheet was frequently broken during the paper-making process. Furthermore, the resultant paper-like sheet was unsatisfactory in quality.

Accordingly, the conventional paper-like polyester fiber sheets made by the wet paper-making method were not successful in practical industrial production and use.

U.S. Pat. No. 2,836,576 and Japanese Patent Application Publication No. 49-8809(1974) disclose a polyester fiber sheet in which undrawn polyester fibers are used as a binding material for drawn polyester fibers. Also, Japanese Patent Application Publication No. 51-2542(1976) discloses a polyester fiber sheet in which undrawn polyester fibers are used for the purpose of enhancing the tear strength of the sheet. However, the above-mentioned polyester fiber sheets exhibited unsatisfactory mechanical strength, touch and appearance, and, therefore, were practically useless.

SUMMARY OF THE INVENTION

An object of the present invention is to provide a paper-like polyester fiber sheet having an excellent mechanical strength and satisfactory touch, appearance and permeability, and a process for producing the same.

Another object of the present invention is to provide a paper-like polyester fiber sheet useful as a filtering sheet, and a process for producing the same.

The above-mentioned objects can be attained by the paper-like polyester fiber sheet of the present invention which comprises polyester staple fibers and which has a coefficient of air flow resistance of from 1,000 to 50,000 dyn.s/cm$^4$ at a volume fraction of the fibers of from 0.01 to 0.24.

The above-mentioned paper-like polyester fiber sheet can be produced by the process of the present invention which comprises preparing a suspension of polyester staple fibers in water, and subjecting the suspension to a wet paper-making procedure to prepare a paper-like polyester fiber sheet having a coefficient of air flow resistance of from 1,000 to 50,000 dyn.s/cm$^4$ at a volume fraction of the fibers of 0.01 to 0.24.

DETAILED DESCRIPTION OF THE INVENTION

The paper-like polyester fiber sheet of the present invention is produced from polyester staple fibers. The polyester staple fibers may consist of drawn polyester staple fibers alone. In this case, it is preferable that the individual drawn polyester staple fibers have a denier of 0.9 or less, more preferably, from 0.01 to 0.9 and a length of 0.3 to 20 mm, more preferably, from 1 to 15 mm.

A denier of more than 0.9 may cause the resultant paper-like sheet to break frequently during the wet paper-making procedure, to have a number of undesirable fluffs and to exhibit an undesirable stiff hand and a poor mechanical strength. Also, a denier less than 0.01 sometimes may cause the fibers to exhibit a poor dispersing property in water and cause the resultant paper-like sheet to exhibit an uneven quality.

A length of less than 0.3 mm of the staple fibers may cause the resultant paper-like sheet to exhibit a poor tensile strength and thus break frequently during the paper-making procedure. Also, a length of more than 20 mm may result in a poor dispersing property of the staple fibers in water due to the fact that the fibers become entangled with each other. This phenomenon sometimes results in an uneven quality of the resultant paper-like sheet.

It was found by the inventors of the present invention that it is preferable that the drawn polyester staple fibers have substantially no crimps. That is, it is preferable that no crimping procedure be applied to the drawn polyester staple fibers. However, the drawn polyester staple fibers may have a small number of crimps naturally created on the fibers during the fiber-producing procedure.

The staple fibers having the above-mentioned denier, length and no crimps are effective for producing the paper-like sheet having a small, uniform thickness and an excellent tear strength.

Also, the polyester staple fibers may consist of a blend of undrawn polyester fibers with drawn polyester fibers.

In this case, it is preferable that the polyester staple fibers may consist of 20% by weight or more, preferably, from 30 to 90% by weight, of undrawn polyester staple fibers and the balance consisting of the drawn polyester staple fibers. Also, it is preferable that the individual undrawn polyester staple fibers have a denier of 1.3 or less, more preferably, 0.9 or less, and a length of 1 to 15 mm. The undrawn polyester staple fibers may have substantially no crimp or may have 20 crimps or less per 25 mm of the fiber:

Furthermore, it is preferable that the undrawn fibers have a birefringence of from 0.01 to 0.06 and a specific gravity of 1.35 or less. The undrawn polyester staple fibers are effective for enhancing the mechanical strength and for improving the touch and appearance of the paper-like sheet. Also, the undrawn polyester staple fibers make possible the production of a very thin and soft paper-like sheet. Furthermore, since the undrawn polyester staple fibers can be fuse-bonded to each other at a low temperature of 110° C. to 200° C., the fibers in the paper-like sheet can be bonded to each other at a relatively low temperature without using a bonding material.

The undrawn polyester staple fibers may be produced from polyester filaments prepared by a high speed melt-spinning method at a spinning speed of 2,000 m/min or more, without drawing the melt-spun filaments.

The paper-like sheet may contain, in addition to the polyester staple fibers, a small amount, for example, 20% by weight or less, of other staple fibers, for example, water-insoluble polyvinyl alcohol fibers, polyamide fibers, polyolefin fibers, rayon fibers, wood pulp, glass fibers or asbestos fibers.

The paper-like polyester sheet of the present invention exhibits a coefficient of air flow resistance of from 1,000 to 50,000 dyn.s/cm$^4$ preferably, from 2,500 to 20,000 dyn.s/cm$^4$ at a volume fraction of the fibers of from 0.01 to 0.24, preferably, from 0.01 to 0.20. When the coefficient of air flow resistance is less than 1,000 dyn.s/cm$^4$, the base structure of the resultant paper sheet is uneven and the touch of the sheet is undesirably stiff. Also, when the coefficient of air flow resistance is more than 50,000 dyn.s/cm$^4$, the resultant paper-like sheet exhibits a poor filtering property, water-permeability and an increased pressure loss. Accordingly, this type of paper-like sheet is useless as a cover layer for a sanitary napkin which is necessary to exhibit a superior liquid-permeability. Also, this type of paper-like sheet is inadequate as a filtering sheet for various gases and liquids.

The coefficient of air flow resistance is calculated in accordance with the following equation.

$$k = \frac{2.5 \times 980}{\alpha \times \nu \times t} \text{ (dyn} \cdot \text{s/cm}^4\text{)}$$

wherein k represents the coefficient of air flow resistance in dyn.s/cm$^4$, $\alpha$ represents the volume fraction of the fibers, $\nu$ represents the degree of air permeability in ml/cm$^2$/s and t represents the thickness of the paper-like sheet in cm.

The thickness t of the paper-like sheet is measured under a load of 3 g/cm$^2$ in accordance with Japanese Industrial Standard (JIS) L-1079.

The volume fraction $\alpha$ of fibers in the paper-like sheet is calculated in accordance with the following equation set forth in JIS L-1079.

$$\alpha = A/10^4 \cdot \rho t$$

wherein A represents a weight of the paper-like sheet in g/m$^2$, $\rho$ represents a true specific gravity of the polyester staple fibers in the paper-like sheet and t represents the thickness of the paper-like sheet in cm.

The air permeability is measured by using a Frazier permeometer in accordance with JIS L-1079.

The polyester staple fibers usable for the present invention are preferably polyethylene terephthalate staple fibers. However, minor portions of the dicarboxylic acid component of the polyethylene terephthalate may be replaced by isophthalic acid, sebacic acid and/or 5-sodium sulfoisophthalic acid. Also, a minor portion of the diol component of the polyethylene terephthalate may be replaced by diethylene glycol, 1,4-butane-diol and/or polyethylene glycol.

The polyester staple fibers may contain one or more additives, for example, a delustering agent, an optical brightening agent, an anti-static agent and/or flame-retardant, in small amounts, for example, 30% by weight or less, preferably, 20% by weight or less.

The paper-like polyester fiber sheet of the present invention is produced by the steps of:

preparing a suspension of polyester staple fibers in water, and;

subjecting the suspension to a wet paper-making procedure so as to provide a paper-like polyester fiber sheet having a coefficient of air flow resistance of from 1000 to 50,000 dyn.s/cm$^4$ at a volume fraction of the fibers of from 0.01 to 0.24.

The paper-making procedure can be carried out without using a binder. However, a small amount of binder for the polyester staple fibers may be used.

In the process of the present invention, the drawn polyester staple fibers having a denier of 0.9 or less, preferably, from 0.01 to 0.9, are uniformly suspended in water. Also the length of the drawn polyester staple fibers of 0.3 to 20 mm is effective for enhancing the uniform suspension property of the fibers in water. Also, no crimp on the fibers is effective for enhancing the tensile strength and minimizing the elongation of the resultant paper-like sheet.

In the process of the present invention, the polyester staple fibers may contain undrawn polyester staple fibers preferably having a denier of 1.3 or less, more preferably, 0.9 or less, a length of 0.3 to 20 mm, more preferably, 1 to 15 mm. Usually, it is preferable that the undrawn polyester fibers have a birefringence of from 0.01 to 0.06 and a specific gravity of 1.35 or less, while the drawn polyester fibers exhibit a birefringence of from 0.12 to 0.26 and a specific gravity of from 1.37 to 1.40. Usually undrawn polyester staple fibers are used in an amount of 20% by weight or more, preferably, 30 to 90% by weight, more preferably, 40 to 70% by weight.

The paper-like polyester fiber sheet of the present invention exhibits a proper softness, an excellent mechanical strength, for example, tensile strength and tear strength, hydrophobic property, resistance to chemicals, dimensional stability and weatherability. Also, the paper-like polyester fiber sheet of the present invention exhibits a satisfactory touch, appearance, air-permeability, water-permeability and filtering property.

Accordingly, the paper-like polyester fiber sheet of the present invention is useful as a packing sheet, a sanitary sheet, a filtering sheet, a lining sheet, a cover sheet for a paper diaper, a cover sheet for a sanitary napkin, a wiper sheet, a tea bag, a table cloth, a heat-insulating sheet, an agricultural lagging sheet, a red tide-fence sheet, an oil-fence sheet and a masking sheet.

The paper-like polyester fiber sheet of the present invention may be impregnated with a resinous material, laminated with other materials, calendered, embossed, or creped. The processed paper-like sheet can be used as a pattern sheet, a leather-like sheet, a sheet for making artificial flowers, an adhesive tape, a wall paper sheet, a backing sheet for a carpet, floor boards, a separator sheet for a lead cell and a disposable cloth.

The specific examples presented below will serve to more fully elaborate how the present invention is practically utilized. However, it should be understood that the examples are only illustrative and in no way limit the scope of the present invention.

In the examples, the birefringence ($\Delta n$) of fiber was determined by using a usual type of polarizing microscope equipped with a sodium lamp as a light source. The specimen to be tested was immersed in $\alpha$-bromonaphthalene. The birefringence ($\Delta n$) was calculated from the value of retardation in accordance with the Berek compensation method.

ing rate of the melted polymer was adjusted to a value adequate for obtaining a denier of the resultant individual fibers as indicated in Table 1. The resultant tow of undrawn filaments had a denier of 400,000. The undrawn filaments were drawn at a draw ratio of 2.8 and relaxed in an atmosphere having a temperature of 140° C. without applying a mechanical crimping procedure to the filaments. The drawn filaments were cut into lengths as indicated in Table 1. The resultant cut fibers had a denier as shown in Table 1.

The cut fibers were suspended in a concentration of 0.5% by weight in water containing 20% of polyvinyl alcohol based on the entire weight of the cut fibers.

The resultant aqueous suspension was subjected to a usual wet paper-making process by using a cylinder paper machine to produce a paper-like sheet having a weight of 50 g/m$^2$. The dispersing property of the cut fibers in water, the paper-forming property of the cut fibers and properties of the resultant paper-like sheet are indicated in Table 1.

TABLE 1

| | Cut Fiber | | | | Paper-like sheet | | | | | |
|---|---|---|---|---|---|---|---|---|---|---|
| Example No. | Denier | Length (mm) | Dispersion Property | Paper-forming Property | Fluffs on Surface | Tensile strength (kg/15 mm) | Ultimate Elongation (%) | Touch | Volume Fraction | Coefficient of Air Flow Resistance (dyn · s/cm$^4$) |
| Example 1 | 0.3 | 5 | good | good | negligible | 2.8 | 5.3 | very soft | 0.128 | 23,400 |
| Example 2 | 0.5 | " | " | " | " | 2.6 | 5.0 | " | 0.108 | 10,500 |
| Example 3 | 0.3 | " | " | " | slight | 2.1 | 3.5 | slightly stiff | 0.124 | 23,400 |
| Comparative Example 1 | 1.0 | 5 | good | poor | remarkable | 1.8 | 2.6 | stiff and rough | 0.098 | 3,800 |
| Comparative Example 2 | 0.5 | 0.2 | " | poor | extremely remarkable | 0.5 | 1.5 | rough | 0.120 | 12,400 |
| Example 4 | 0.5 | 0.4 | good | good | slight | 1.0 | 2.0 | slightly rough | 0.118 | 12,000 |
| Example 5 | " | 1 | " | " | negligible | 1.8 | 3.0 | soft | 0.119 | 11,800 |
| Example 6 | " | 3 | " | " | " | 2.4 | 4.5 | " | 0.114 | 11,200 |
| Example 7 | " | 10 | " | " | " | 3.0 | 5.5 | very soft | 0.105 | 9,800 |
| Example 8 | " | 15 | " | " | " | 3.3 | 5.6 | " | 0.107 | 9,200 |
| Example 9 | " | 20 | " | " | " | 3.5 | 5.8 | soft | 0.098 | 8,500 |
| Comparative Example 3 | 0.5 | 25 | poor | poor | slight | 3.6 | 6.0 | soft | 0.095 | 3,200 |

The specific gravity of fiber was determined by placing the specimen in a density-gradient tube containing various mixtures of n-heptane with tetrachloromethane and by allowing the specimen to be suspended in a certain mixture at a temperature of 25° C. for 6 hours.

The number of crimps in the fibers was determined in accordance with JIS L-1074.

The filtering property of the sheet was determined in accordance with JIS Z 890, by blowing air containing 30 mg/m$^3$ of 8 types of standard dust toward a specimen composed of two sheets superimposed on each other so as to allow the air stream to pass through the specimen at a linear speed of 0.5 m/sec. The efficiency of collecting the dust by the specimen and the pressure loss due to the specimen were determined.

EXAMPLES 1 THROUGH 9 AND COMPARATIVE EXAMPLES 1 THROUGH 3

In each of the Examples 1 through 9 and Comparative Examples 1 through 3, polyethylene terephthalate chips having an intrinsic viscosity of 0.65 determined in o-chlorophenol at a temperature of 35° C., were melted at a temperature of 300° C. in an extruder and extruded through a spinneret having 1200 spinning orifices at a temperature of 285° C. The extruded filamentary streams of the melted polymer were solidified by cooling and taken up at a speed of 1000 m/min. The extrud- From Table 1, it is clear that in Examples 1 through 9 in accordance with the present invention, the cut polyester fibers were uniformly dispersed in water and the paper-making procedure could be carried out without breakage of the resultant sheet. Also, the resultant sheet exhibits satisfactory volume fraction, coefficient of air flow resistance, tensile strength, ultimate elongation, touch and appearance.

In Comparative Example 1 in which the denier of the drawn cut fibers was more than 0.9, the paper-making procedure was frequently interrupted due to the breakage of the resultant sheet. Also, the resultant sheet exhibits a poor tensile strength, a poor appearance due to a number of fluffs formed on the surface of the sheet and a poor touch.

In Comparative Example 2, in which the length of the drawn cut fibers was less than 0.3 mm, the paper-making procedure was often interrupted because of breakage of the resultant sheet. The resultant sheet had an extremely poor tensile strength, a poor ultimate elongation, and a poor appearance due to a number of fluffs formed on the surface of the sheet and a poor touch.

In Comparative Example 3, in which the length of the drawn cut fibers was more than 20 mm, it was difficult to uniformly disperse the fibers in water, and the paper-making procedure was frequently interrupted because of breakage of the resultant sheet. The resultant sheet had a number of fluffs formed on the surface thereof.

EXAMPLES 10 THROUGH 12

In each of Examples 10 through 12, a polyethylene terephthalate type polyester containing, as a dicarboxylic acid component, 2.6 molar % of 5-sodium sulfoisophthalic acid and having an intrinsic viscosity of 0.38, was melted at a temperature of 290° C. The melt was extruded through an spinneret having 900 spinning orifices at a temperature of 270° C. The extruded filamentary streams of the melt were solidified and taken up at a speed of 1100 m/min to produce undrawn filaments each having a denier of 1.2. A tow having a total denier of 400,000 was prepared from the undrawn filaments. The tow was drawn at a draw ratio of 3.0.

In Example 10, no crimping procedure was applied to the drawn two.

In each of the Examples 11 and 12, the tow was subjected to a mechanical crimping procedure so as to create crimps, in the amount as indicated in Table 2, on the individual filaments.

In each of the Examples 10 through 12, the tow was relaxed at a temperature of 130° C. while allowing the tow to freely shrink. The resultant relaxed individual filaments each had a denier of 0.5. The filaments were cut to provide cut fibers each having a length of 10 mm.

The cut fibers were dispersed in a concentration of 0.5% by weight in water in which 10% by weight of polyvinyl alcohol based on the entire weight of the cut fibers, was dissolved.

The resultant suspension was subjected to a usual paper-making procedure using a cylinder paper machine to prepare a paper-like sheet having a weight of 30 g/m$^2$. The paper-forming property of the suspension and properties of the resultant sheet are indicated in Table 2.

used. Also, in Example 10, the resultant paper-like sheet exhibited a satisfactory air-permeability.

EXAMPLES 13 THROUGH 16 AND COMPARATIVE EXAMPLE 4 THROUGH 6

In each of Examples 13 and 14 and Comparative Example 4, the same polyester chips as those described in Example 1 were melted at a temperature of 300° C. The melt was extruded through a spinneret having 250 spinning orifices. The filamentary streams of the melt were solidified and taken up at a speed of 3000 m/min. The resultant undrawn filaments were drawn at a draw ratio of 1.3 and relaxed at a temperature of 140° C. so as to allow the filaments to freely shrink. The relaxed filaments were cut to provide cut fibers each having a length of 5 mm.

In each of Examples 15 and 16 and Comparative Examples 5 and 6, the same cut fiber-producing procedures as those described in Example 1 were carried out except that the extruding rate was adjusted to a value adequate to obtain a denier of the relaxed fibers as indicated in Table 3, and the cut fiber each had a length of 5 mm.

In each of Examples 13 through 16 and Comparative Examples 4 through 6, 4 kg of the cut fibers were suspended, together with 1 kg of polyvinyl alcohol fiber binder, each fiber having a denier of 1, a length of 3 mm and softening point of about 70° C. in water, in 1 metric ton of water by using a beater, to prepare a fiber slurry. The fiber slurry was mixed with a 1% solution of polyacrylamide at a rate of one part by weight of the solution per 200 parts by weight of the fiber slurry.

The mixture was subjected to a usual paper-making procedure by using a cylinder paper machine to produce a sheet at a speed of 12 m/min. The resultant sheet had a weight of about 50 g/m$^2$.

The sheets produced in Examples 13 and 14 were pressed by using a calender roll having a working width of 50 cm under a pressure of 10 tons at a temperature of 180° C. in Example 13 and 130° C. in Example 14.

The properties of the resultant sheets are indicated in Table 3.

TABLE 2

| | | | | Paper-like sheet | | | | | |
|---|---|---|---|---|---|---|---|---|---|
| | Crimp | Suspension | | | | | | | |
| Example No. | Number (crimps/25 mm) | Dispersion property | Paper-forming property | Fluffs on Surface | Tensile Strength (kg/15 mm) | Ultimate Elongation (%) | Touch | Volume of Fraction | Coefficient of Air Flow Resistance (dyn · s/cm$^4$) |
| Example 10 | 0 | good | good | negligible | 3.4 | 5.6 | soft | 0.115 | 10,800 |
| Example 11 | 1 | " | " | " | 2.9 | 7.3 | " | 0.072 | 7,200 |
| Example 12 | 8 | " | " | " | 2.2 | 12.0 | " | 0.045 | 4,300 |

Table 2 clearly shows that in Examples 11 and 12, the crimped fibers resulted in inferior tensile strength, ultimate elongation and coefficient of air flow resistance to those in Example 10 in which non-crimped fibers were

TABLE 3

| | | | | | Paper-like Sheet | | | | | |
|---|---|---|---|---|---|---|---|---|---|---|
| | Cut Fiber | | Fiber Slurry | | | | | | | |
| Example No. | Denier | Diameter (μm) | Dispersion Property | Paper-forming Property | Touch | Volume fraction | Coefficient of Air Flow Resistance (dyn · s/cm$^4$) | Tensile Strength (kg/15 mm) | Efficiency of Collection (%) | Pressure Loss (Pa) |
| Comparative Example 4 | 0.2 | 4.5 | good | good | stiff | 0.253 | 52,100 | 8.5 | 73 | 860 |
| Example 13 | 0.2 | 4.5 | " | " | good | 0.212 | 23,500 | 7.8 | 65 | 480 |
| Example 14 | 0.2 | 4.5 | " | " | very good | 0.186 | 18,900 | 6.9 | 62 | 340 |
| Example 15 | 0.5 | 7.2 | " | " | " | 0.115 | 10,500 | 6.6 | 60 | 250 |
| Example 16 | 0.8 | 9.1 | " | " | good | 0.076 | 3,800 | 5.7 | 51 | 210 |
| Comparative Example 5 | 1.5 | 12.4 | poor | poor | stiff | 0.055 | 2,100 | 3.2 | 40 | 150 |
| Comparative | 3.0 | 17.5 | very | very | very | 0.032 | 800 | 1.5 | 18 | 110 |

TABLE 3-continued

| Example No. | Cut Fiber Denier | Cut Fiber Diameter (μm) | Fiber Slurry Dispersion Property | Fiber Slurry Paper-forming Property | Paper-like Sheet Touch | Paper-like Sheet Volume fraction | Paper-like Sheet Coefficient of Air Flow Resistance (dyn · s/cm$^4$) | Paper-like Sheet Tensile Strength (kg/15 mm) | Paper-like Sheet Efficiency of Collection (%) | Paper-like Sheet Pressure Loss (Pa) |
|---|---|---|---|---|---|---|---|---|---|---|
| Example 6 | | | poor | poor | stiff | | | | | |

The comparative sheet prepared in Comparative Example 4 had a large coefficient of air flow resistance of more than 50,000 dyn.s/cm$^4$ and a large volume fraction of the fibers of more than 0.24 and, therefore, exhibited an undesirable stiff touch and a large pressure loss.

In Comparative Example 5, the cut fibers having a large denier of 1.5, exhibited a poor dispersion property and a poor paper-forming property. Also, the resultant sheet exhibited a stiff touch and a poor tensile strength and a poor collection efficiency.

In Comparative Example 6, the cut fibers having a large denier of 3, had a poor dispersion property and a poor paper-forming property. The resultant sheet exhibited a poor coefficient of air flow resistance of less than 1,000 dyn.s/cm$^4$, an extremely poor collection efficiency and an undesirably stiff touch.

The sheets produced in Examples 13 through 16 exhibited proper volume fraction of the fibers and coefficient of air flow resistance and, therefore, exhibited a proper filtering property including both the proper collection efficiency and pressure loss, and a satisfactory soft touch. Especially, the sheets produced in Examples 14 through 16 had a coefficient of air flow resistance in a range of from 2,500 to 20,000 dyn.s/cm$^4$, and, therefore, exhibited an excellent filtering property, a satisfactory soft touch and a superior tensile strength.

EXAMPLES 17 THROUGH 23 AND COMPARATIVE EXAMPLES 7 THROUGH 9

In each of the Examples 17 through 22 and Comparative Examples 7 through 9, the same procedures for producing drawn, relaxed, cut polyethlene terephthalate fibers as those described in Example 1 were carried out, except that the extruding rate was altered so that the finally resulting cut fibers had a denier as indicated in Table 4.

Separately, polyethylene terephthalate chips having an intrinsic viscosity of 0.64 were fed into an extruder, melted therein at a temperature of 305° C. The melt was extruded through a spinneret having 500 spinning orifices at a temperature of 285° C. at an extruding rate adequate for obtaining the final product having the denier indicated in Table 4. The extruded filamentary streams of the melt was solidified by cooling and the solidified filament were taken up at a speed of 900 m/min. The resultant undrawn filaments had a denier as indicated in Table 4, and a specific gravity in the range of from 1.335 to 1.340 and a birefringence as indicated in Table 4. The undrawn filaments were cut to prepare cut fibers having a length of 5 mm.

Equivalent amounts of the drawn cut fibers and the undrawn cut fibers were suspended in a concentration of 0.5% by weight in water. In this procedure, 0.01 g/l of a thickener consisting of a polyacrylamide were added to the cut fiber suspension.

The cut fiber suspension was subjected to a usual paper-making procedure by using a cylinder paper-forming test machine. A paper-like sheet was formed at a speed of 12 m/min, dried at a temperature of 120° C. and, then, wound up. The resultant sheet had a weight of 50 g/m$^2$, and exhibited the properties as indicated in Table 4.

In Example 23, the same procedures as those described above were carried out, except that no undrawn cut fibers were used. The results are indicated in Table 4.

TABLE 4

| Example No. | Undrawn fiber Denier | Undrawn fiber Birefringence (Δn) | Drawn fiber Denier | Paper-like sheet Frequency in breakage of sheet during paper-making procedure (Times/60 min) | Paper-like sheet Tensile strength (kg/15 mm) | Paper-like sheet Touch | Paper-like sheet Appearance | Paper-like sheet Volume fraction | Paper-like sheet Coefficient of air flow resistance (dyn · s/cm$^4$) |
|---|---|---|---|---|---|---|---|---|---|
| Example 17 | 2.7 | 0.007 | 0.5 | 0 | 2.5 | very soft | good | 0.098 | 9,800 |
| Example 18 | " | " | 0.9 | 0 | 2.0 | soft | " | 0.081 | 9,300 |
| Comparative Example 7 | " | " | 1.0 | 0.8 | 1.8 | stiff | a lot of fluff | 0.072 | 8,200 |
| Example 19 | 5.0 | 0.006 | 0.5 | 0 | 2.3 | very soft | good | 0.085 | 8,300 |
| Example 20 | " | " | 0.9 | 0.4 | 1.9 | soft | " | 0.073 | 7,600 |
| Comparative Example 8 | " | " | 1.0 | 1.0 | 1.5 | stiff | extreme amount of fluff | 0.069 | 6,500 |
| Example 21 | 9.5 | 0.004 | 0.5 | 0 | 2.0 | soft | good | 0.072 | 6,900 |
| Example 22 | " | " | 0.9 | 0.5 | 1.5 | soft | " | 0.068 | 5,200 |
| Comparative Example 9 | " | " | 1.0 | 1.5 | 1.2 | stiff | extreme amount of fluff | 0.061 | 4,000 |
| Example 23 | — | — | 0.5 | 0.5 | 2.2 | slightly stiff | small amount of fluff | 0.069 | 10,500 |

Table 4 clearly shows that when the undrawn polyester fibers are mixed with the drawn polyester fibers having a denier of 0.9 or less, the resultant paper-like sheets exhibit satisfactory properties. Also, the mixture of the drawn fibers and the undrawn fibers could be uniformly dispersed in water and exhibited a good paper-forming property.

EXAMPLES 24 THROUGH 28

In each of the Examples 24 through 28, undrawn polyester fibers were prepared as follows.

Polyethylene terephthalate chips having an intrinsic viscosity of 0.64 were fed into an extruder and melted therein at a temperature of 300° C. The melt was extruded through a spinneret having 900 spinning orifices at a temperature of 285° C. at a extruding rate adequate for obtaining the denier of the final product fibers. The extruded filamentary streams of the melt were solidified by cooling and the solidified filaments were taken up at a speed of 1100 m/min. The resultant undrawn filaments were cut to prepare undrawn cut fibers having a length of 5 mm. The cut fibers had a denier and a birefringence as indicated in Table 5. Separately, drawn polyethylene terephthalate cut fibers having a denier of 0.5 and a length of 5 mm and exhibiting a birefringence of 0.180 and a specific gravity of 1.383, were prepared.

The drawn cut fibers were mixed with the undrawn cut fibers in a mixing ratio of 1:1 and the mixture was suspended in a concentration of 0.5% by weight in water. In this procedure, a binder consisting of polyvinyl alcohol fibers having a denier of 1.0, a length of 3 mm and a softening point in water of about 70° C., was added in an amount of 10% based on the total weight of the undrawn and drawn cut fibers, into the cut fiber suspension. Also, 0.01 g/l of a thickener consisting of a polyacrylamide were added to the cut fiber suspension. The cut fiber suspension was subjected to a usual paper-making procedure by using a cylinder paper-forming test machine. A sheet was prepared at a speed of 12 m/min, dried at a temperature of 120° C. and then wound up. The resultant sheet had a weight of 50 g/m$^2$ and properties as indicated in Table 5.

TABLE 5

| Example No. | Undrawn fiber Denier | Undrawn fiber Birefringence (Δ) | Frequency in breakage of sheet (Times/60 min) | Paper-like sheet Tensile strength (kg/15 mm) | Paper-like sheet Volume fraction | Paper-like sheet Coefficient of air flow resistance (dyn · s/cm$^4$) | Paper-like sheet Touch | Paper-like sheet Appearance |
|---|---|---|---|---|---|---|---|---|
| Example 24 | 2.0 | 0.010 | 3 | 1.8 | 0.054 | 6,500 | stiff | small amount of fluff |
| Example 25 | 1.4 | 0.014 | 2 | 2.0 | 0.069 | 7,300 | slightly stiff | small amount of fluff |
| Example 26 | 1.3 | 0.016 | 0 | 2.5 | 0.072 | 8,000 | soft | good |
| Example 27 | 0.9 | 0.019 | 0 | 2.4 | 0.081 | 8,500 | very soft | " |
| Example 28 | 0.5 | 0.026 | 0 | 2.8 | 0.095 | 9,300 | " | " |

EXAMPLES 29 THROUGH 32

In each of the Examples 29 through 32, undrawn cut fibers were prepared as follows.

Polyethylene terephthalate type polyester containing, as a dicarboxylic acid component, 2.6 molar % of 5-sodium sulfoisophthalic acid, and having an intrinsic viscosity of 0.48, was fed into an extruder and melted therein at a temperature of 305° C. The melt was extruded at a temperature of 290° C. through a spinneret having 900 spinning orifices. The extruded filamentary streams of the melt were solidified by cooling and the solidified filaments were taken up at a speed of 1200 m/min. The resultant undrawn filaments had a denier of 1.1, a birefringence of 0.023 and a specific gravity of 1.337. The undrawn filaments were cut to prepare cut fibers having a length of 5 mm.

The undrawn cut fibers were mixed with the same drawn cut fibers as those described in Example 24 in a mixing ratio as indicated in Table 6. The mixture was subjected to the same sheet-forming procedures as those described in Example 24, except that the resultant sheet had a weight of 30 g/m$^2$.

The results are indicated in Table 6.

TABLE 6

| Example No. | Mixing ratio undrawn fibers/drawn fibers (%) | Frequency in breakage of sheet during paper-forming procedure (Times/60 min) | Paper-like sheet Tensile strength (kg/15 mm) | Paper-like sheet Volume fraction | Paper-like sheet Coefficient of air flow resistance (dyn · s/cm$^4$) | Paper-like sheet Touch | Paper-like sheet Appearance |
|---|---|---|---|---|---|---|---|
| Example 29 | 18 | 3 | 0.6 | 0.099 | 10,100 | slightly stiff | small amount of fluff |
| Example 30 | 21 | 1 | 0.8 | 0.081 | 9,800 | soft | good |
| Example 31 | 35 | 0 | 1.2 | 0.079 | 7,200 | " | " |
| Example 32 | 70 | 0 | 1.5 | 0.075 | 6,500 | " | " |

We claim:

1. A paper-like polyester fiber sheet, comprising polyester staple fibers and having a coefficient of air flow resistance of from 2,500 to 23,500 dyn.s/cm$^4$ at a volume fraction of the fibers of from 0.01 to 0.24, said polyester staple fibers containing drawn polyester staple fibers each having a denier of 0.01 to 0.9 and a length of from 0.3 to 20 mm.

2. A sheet as claimed in claim 1, wherein said polyester staple fibers consist essentially of drawn polyester staple fibers alone.

3. A sheet as claimed in claim 1, wherein the individual drawn polyester staple fibers have substantially no crimp.

4. A sheet as claimed in claim 1, wherein said polyester staple fibers consist essentially of a blend of undrawn polyester staple fibers and drawn polyester staple fibers.

5. A sheet as claimed in claim 4, wherein said undrawn polyester staple fibers in said blend are present in an amount of at least 20% by weight.

6. A sheet as claimed in claim 5, wherein said undrawn polyester staple fibers have a denier of 1.3 or less.

7. A sheet as claimed in claim 6, wherein the denier of said undrawn polyester staple fibers is 0.9 or less.

8. A sheet as claimed in claim 5, wherein said undrawn polyester staple fibers have a birefringence of from 0.01 to 0.06 and a specific gravity of 1.35 or less.

9. A sheet as claimed in claim 2 wherein the individual drawn polyester staple fibers have a length of from 1 to 15 mm.

10. A sheet as claimed in claim 5 wherein said undrawn polyester staple fibers are present in an amount of from 30 to 90% by weight.

11. A sheet as claimed in claim 7 wherein said undrawn polyester staple fibers have a length of from 1 to 15 mm.

12. A sheet as claimed in claim 1 further comprising up to 20% by weight of staple fibers selected from the group consisting of water-insoluble polyvinylalcohol fibers, polyamide fibers, polyolefin fibers, rayon fibers, wood pulp, glass fibers and asbestos.

13. A sheet as claimed in claim 4 further comprising up to 20% by weight of staple fibers selected from the group consisting of water-insoluble polyvinylalcohol fibers, polyamide fibers, polyolefin fibers, rayon fibers, wood pulp, glass fibers and asbestos.

14. A sheet as claimed in claim 1 wherein the airflow resistance is from 2,500 to 20,000 dyn.s/cm$^4$.

15. A sheet as claimed in claim 1 wherein the volume fraction of the fibers is from 0.01 to 0.20.

16. A sheet as claimed in claim 14 wherein the volume fraction of the fibers is from 0.01 to 0.20.

17. A sheet as claimed in claim 1 wherein said fibers are polyethylene terephthalate staple fibers.

18. A sheet as claimed in claim 1 wherein said fibers contain up to 30% by weight of at least one additive selected from the group consisting of a delustering agent, an optical brightening agent, an antistatic agent and a flame retarding agent.

19. A sheet as claimed in claim 17 wherein said fibers contain up to 30% by weight of at least one additive selected from the group consisting of a delustering agent, an optical brightening agent, an antistatic agent and a flame retarding agent.

20. A sheet as claimed in claim 10 wherein said undrawn polyester staple fibers have a denier of 1.3 or less.

21. A sheet as claimed in claim 10, wherein said undrawn polyester staple fibers have a birefringence of from 0.01 to 0.06 and a specific gravity of 1.35 or less.

* * * * *